US005295786A

United States Patent [19]

Kajiwara

[11] Patent Number: 5,295,786

[45] Date of Patent: Mar. 22, 1994

[54] LINER RING FOR A PUMP

[75] Inventor: Ken-ichi Kajiwara, Tokyo, Japan

[73] Assignee: Ebara Corporation, Tokyo, Japan

[21] Appl. No.: 811,070

[22] Filed: Dec. 20, 1991

[30] Foreign Application Priority Data

Dec. 27, 1990 [JP] Japan ..... 2-402357[U]

[51] Int. Cl.[5] ..... F04D 29/16

[52] U.S. Cl. ..... 415/172.1; 415/173.1; 415/173.3; 277/183; 277/184; 277/189; 277/DIG. 6

[58] Field of Search ..... 415/170.1, 172.1, 173.1, 415/173.3, 174.2; 277/181, 182, 183, 184, 189, DIG. 6

[56] References Cited

U.S. PATENT DOCUMENTS

| | | | |
|---|---|---|---|
| 3,995,868 | 12/1976 | Smith | 277/DIG. 6 |
| 4,018,544 | 4/1977 | Eberhard . | |
| 4,243,233 | 1/1981 | Arai | 415/172.1 |
| 4,909,707 | 3/1990 | Wauligman et al. . | |
| 4,948,336 | 8/1990 | Mosure | 415/172.1 |
| 5,112,190 | 5/1992 | Kajiwara et al. | 415/206 |

FOREIGN PATENT DOCUMENTS

| | | | |
|---|---|---|---|
| 0167837 | 1/1986 | European Pat. Off. . | |
| 0315941 | 11/1988 | European Pat. Off. . | |
| 3530986 | 3/1987 | Fed. Rep. of Germany . | |
| 0116705 | 9/1979 | Japan | 415/172.1 |
| 951750 | 3/1964 | United Kingdom . | |

*Primary Examiner*—Edward K. Look
*Assistant Examiner*—Christopher Verdier
*Attorney, Agent, or Firm*—Wenderoth, Lind & Ponack

[57] ABSTRACT

A liner ring for a pump is provided between a pump casing and an impeller to check counterflow therebetween. The liner ring comprises a housing provided on a casing body, an annular sealing member provided in the housing in such a manner that a predetermined gap is provided in a radial direction between the sealing member and an impeller, and an elastic member provided between the sealing member and the housing. In accordance with the present invention, the sealing member is housed in the housing made of sheet metal in such a manner that a predetermined gap is provided between the sliding member and the housing. The gap corresponds to the variation in dimensions due to the difference in thermal expansion coefficients of the sealing member and the housing. The gap is sealed by the elastic member provided between the sealing member and the housing.

22 Claims, 5 Drawing Sheets

LINER RING FOR A PUMP

BACKGROUND OF THE INVENTION

The present invention relates to a liner ring for a pump, and more particularly to a pump liner ring which is provided between a pump casing and an impeller to check counterflow therebetween.

Conventionally, in a centrifugal pump, in order to prevent the liquid discharged out of the impeller from being leaked toward the suction side of the pump casing, there are provided a wearing ring (or impeller ring) on the side of the impeller, and a liner ring (or a casing ring) on the side of the casing in confrontation with the wearing ring. The wearing ring and the liner ring are provided in such a manner that the clearance between the rings is kept small.

Since the wear condition of the liner ring or the wearing ring cannot be easily observed from the outside, wear resisting material must be used for the liner ring or the wearing ring. When a non-corrosive liquid is used in the pump, bronze, cast iron or surface hardened steel or the like is employed as the wear resisting material. On the contrary, when a corrosive liquid is used in the pump, 18Cr-8Ni stainless steel is often employed, but such stainless steel is not effective against wear. Therefore, in this case, the clearance between the rotating member and the stationary member must be larger than the average clearance commonly used.

In addition to the above-mentioned metal for a liner ring, the use of carbon material or Teflon (trademark) material having excellent wear resistance is desirable.

However, carbon material or Teflon material is difficult to handle when it is used in a high temperature environment or the like. That is, since material, such as carbon or Teflon, which is suitable for an annular member has a different thermal expansion coefficient than that of metal used for a pump casing, such material cannot be installed on the pump casing by mean of a force fit which is generally used for liner rings made of metal. Therefore, a housing made of rubber is often used in conjunction with the annular sealing member made of carbon or Teflon, or the usage temperature range of the liner ring is often limited to a certain range.

SUMMARY OF THE INVENTION

It is therefore an object of the present invention to provide a pump liner ring comprising carbon material or Teflon material which is difficult to handle when it is used in high temperature liquids, and which can be easily used in the same manner as the liner ring made of metal.

In order to achieve the above object, in accordance with one aspect of the present invention, there is provided a liner ring for a pump, comprising: a housing provided on a casing body; an annular sealing member provided in the housing in such a manner that a predetermined gap is provided in a radial direction between the sealing member and an impeller; and an elastic member provided between the sealing member and the housing.

According to another aspect of the present invention the liner ring further comprises a means for preventing the sealing member from rotating relative to the housing.

According to still another aspect of the present invention, the sealing member comprises material having a thermal expansion coefficient larger than that of the housing. A predetermined gap is formed between the housing and the sealing member. The gap corresponds to variations in dimensions of the housing and the sealing member due to a difference in the thermal expansion coefficients of the housing and the sealing member, and a predetermined pre-load is applied to the elastic member so as to enable the elastic member to perform a sealing function at the lowest usage temperature.

According to still another aspect of the present invention, the sealing member comprises a material having a thermal expansion coefficient smaller than that of the housing, the sealing member is tightly fitted with the housing, and a predetermined pre-load is applied to the elastic member so as to enable the elastic member to perform a sealing function at the highest usage temperature.

According to still another aspect of the invention, the housing is made of sheet metal and is pressed into shape, the housing is in the form of a cylindrical receptacle-like body comprising a cylindrical side wall, a bottom wall (or housing end wall) and a corner portion between the cylindrical side wall and the bottom wall. The cylindrical side wall is formed at the side of the impeller with a flange, and the elastic member is located at the corner portion.

According to still another aspect of the present invention, the flange of the housing is formed with an engaging member which is bent radially inwardly after inserting the sliding member into the housing so that the engaging member prevents the sealing member from moving in an axial direction and/or rotating in a circumferential direction.

According to still another aspect of the present invention, the housing is formed at the bottom wall thereof with a first engaging member, the sealing member is formed with a second engaging member, and the first engaging member is engageable with the second engaging member so as to prevent the sealing member from rotating relative to the housing.

In accordance with the present invention, the sliding member is housed in the housing made of sheet metal in such a manner that a predetermined gap is provided between the sealing member and the housing. The gap corresponds to the variation in dimensions due to the difference in thermal expansion coefficients of the sealing member and the housing. The gap is sealed by the elastic member provided between the sealing member and the housing.

Further, the sealing member is prevented from moving in an axial direction by the engaging member which is formed on the flange of the housing and bent radially inwardly. If an engaging member is provided on the sealing member, the sealing member may be prevented from rotating relative to the housing.

Furthermore, the sealing member is prevented from rotating relative to the housing by engagement of the first engaging member provided on the housing and the second member The above and other object, features and advantages of the present invention will become apparent from the following description when taken in conjunction with the accompanying drawings in which preferred embodiments of the present invention are shown by way of illustrative example.

DETAILED DESCRIPTION OF THE PREFERRED EMBODIMENT

A liner ring according to an embodiment of the present invention will be described below with reference to FIGS. 1 through 4.

Figure 1:
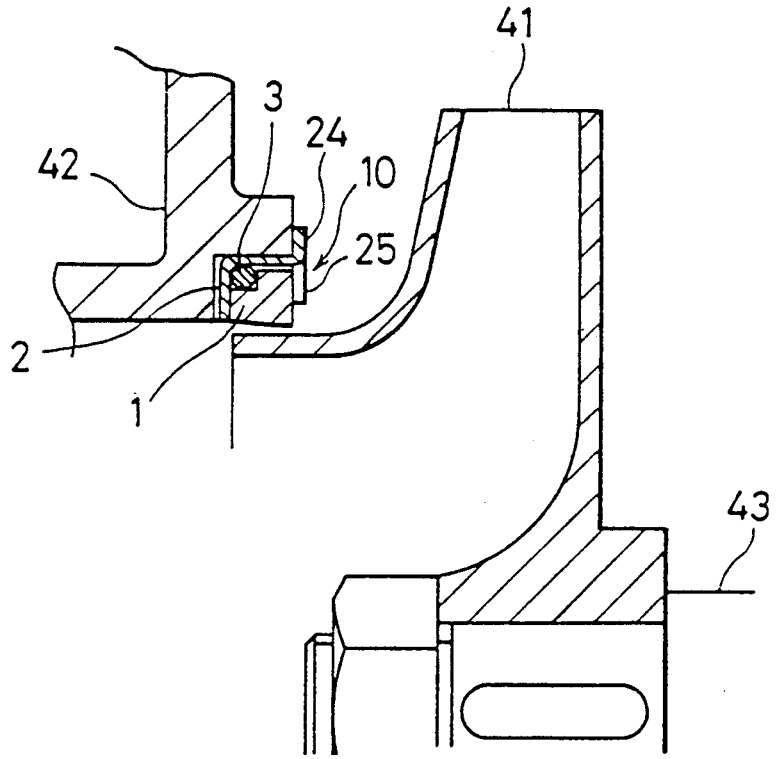
FIG. 1 is a cross-sectional view showing a liner ring incorporated in a pump casing according to an embodiment of the present invention.
Figure 2:
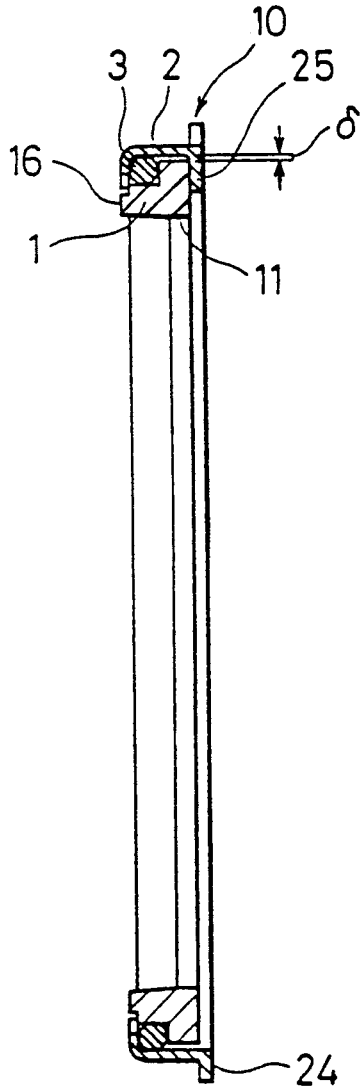
FIG. 2 is a cross-sectional view showing the liner ring according to the embodiment of FIG. 1.
Figure 3A:
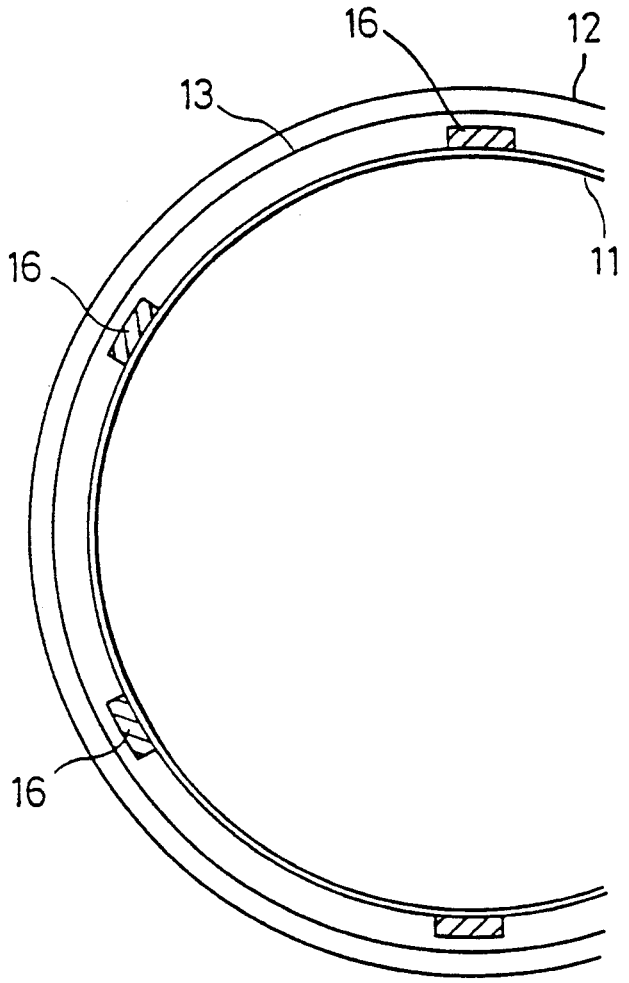
FIGS. 3(*a*) and 3(*b*) show a sliding member of the liner ring according to the embodiment of FIG. 1, FIG. 3(*a*) showing a cross-sectional view taken along line III—III of FIG. 3(*b*) and FIG. 3(*b*) showing a cross-sectional view of the sliding member.
Figure 3B:
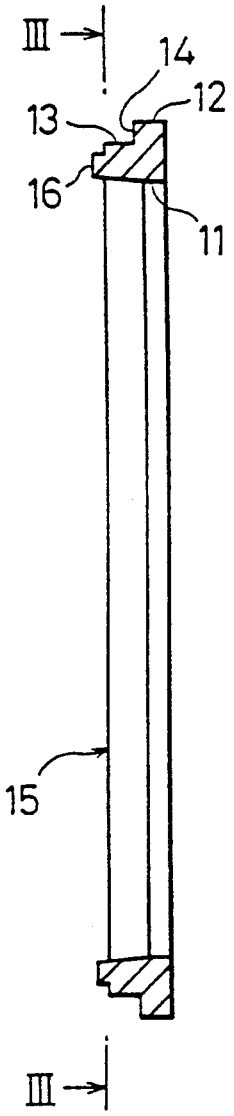

FIG. 1 shows a liner ring of the present invention which is incorporated in a pump casing. A liner ring 10 is provided between a pump casing body 42 and an impeller 41 which is rotatably supported by a shaft 43 as shown in FIG. 1. The liner ring 10 comprises an annular sealing member 1 made of carbon material or Teflon material, a housing 2 made of metal for housing the sliding member 1 and an O ring 3 made of rubber as shown in FIG. 2. As shown in FIGS. 3(*a*) and 3(*b*), the sealing member 1 is formed with an inner cylindrical surface 11 which confronts an end portion of the impeller 41 located at the suction side thereof so as to form a predetermined gap therebetween (see FIG. 1). The inner cylindrical surface 11 is slightly inclined so as to make the gap between the sealing member 1 and the impeller 41 decrease from the inlet side toward the outlet side of the impeller 41 as shown in FIG. 1. Further, the sealing member 1 is formed with an outermost cylindrical surface 12, an intermediate cylindrical surface 13, and an end surface 14 which extends vertically and connects the outermost cylindrical surface 12 with the intermediate cylindrical surface 13 as shown in FIGS. 3(*a*) and 3(*b*). The intermediate cylindrical surface 13 and the end surface 14 define a space for accommodating the O ring 3. The sealing member 1 has an opposite end, which is located on a side of the sliding member 1 opposite the impeller 41, and a plurality of projections 16 (six in this embodiment) are formed at regular intervals on the opposite end.

Figure 4A:
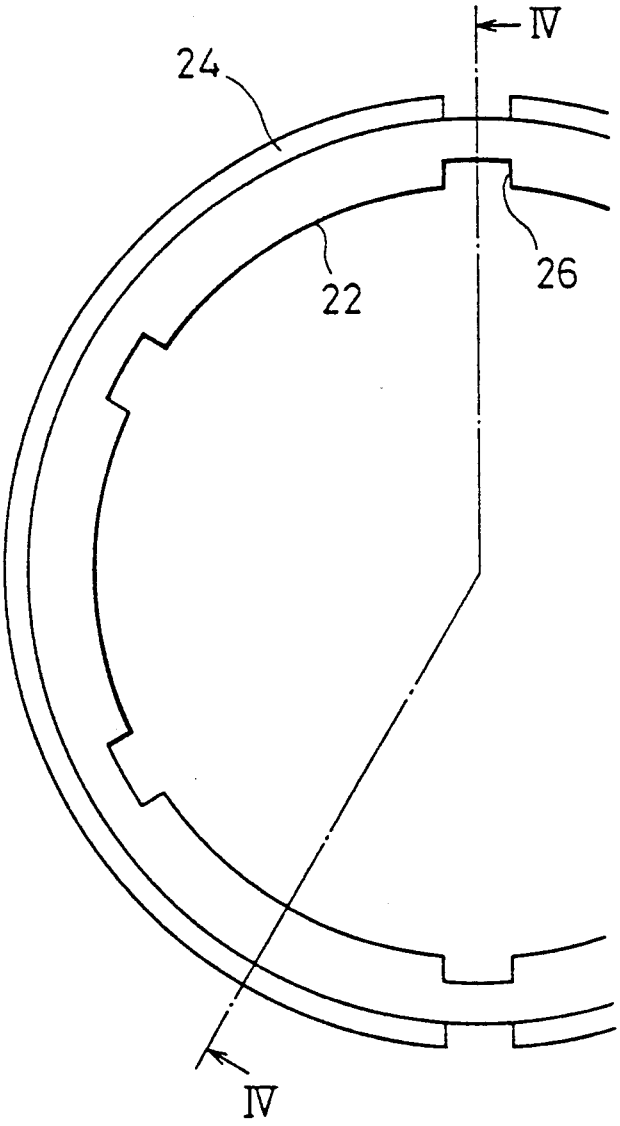
FIGS. 4(*a*) and 4(*b*) show a housing according to the present invention, FIG. 4(*a*) being a front view showing the housing and FIG. 4(*b*) being a cross-sectional view taken along a line IV-IV of FIG. 4(*a*)
Figure 4B:
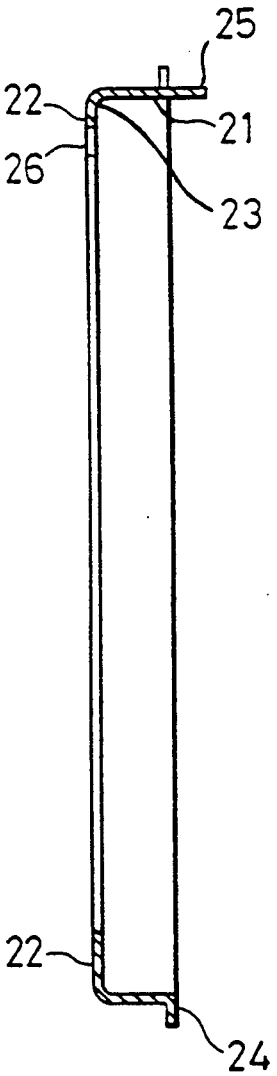

On the other hand, as shown in FIGS. 4(*a*) and 4(*b*), the housing 2 housing the sealing member 1 is provided with a cylindrical side wall 21, a bottom wall (or housing end wall) 22 and a corner portion 23 which connects the cylindrical side wall 21 and the bottom wall 22. The housing 2 is made of sheet metal pressed into shape and is provided with a flange 24 which extends radially from the cylindrical side wall 21 at the side of the impeller 42. The flange 24 serves as a stopper for stopping an axial movement of the housing 2 relative to the pump casing body 42 (see FIG. 1). Further, the flange 24 is formed with pawls 25 constituting an engaging portion which are formed by means of two adjacent slits extending radially outwardly. That is, after inserting the O ring 3 and the sealing member 1 into the housing 2, the pawls 25 are bent radially inwardly, thereby fixing them to the housing 2.

Further, the housing 2 is provided at the bottom wall 22 with a plurality of notches 26, at regular intervals, which are engageable with the projections 16 (FIG. 3) of the sliding member 1.

As shown in FIG. 2, the sealing member 1 is housed in the housing 2 in such a manner that a gap δ is provided between the outermost cylindrical surface 12 and the cylindrical side wall 21 of the housing 2 in order to absorb (or accommodate) variation in the dimensions caused by differences in the thermal expansion coefficients of the two materials and the temperature of the liquid. Further, the O ring 3 is disposed in the annular space defined by the intermediate cylindrical surface 13, the end surface 14 and the corner portion 23 of the housing 2, whereby the gap δ is sealed by the O ring 3.

With the above structure, the sealing member confronts the impeller 41 with a certain gap therebetween. The sealing member 1 is inserted into the housing 2 so as to form the gap δ corresponding to the variation in dimension due to the difference in thermal expansion coefficients of the respective members and the temperature of the liquid. The gap δ is sealed by the O ring 3 as mentioned above.

Further, the sealing member 1 is fixed to the housing 2 by the pawls 25 provided on the flanges 24. The pawls 25 are bent radially inwardly after inserting the sliding member 1 and the O ring 3 into the housing 2, thereby stopping the axial movement of the sliding member 1. Further, in order to prevent the sealing member 1 from rotating relative to the housing 2, engaging means may be provided at the inner surfaces of the pawls 25 and at the end surface of the sealing member 1, respectively.

On the other hand, the sealing member 1 is prevented from rotating relative to the housing 2 by engagement of the notches 26 formed on the bottom wall 22 with the projections 16 formed on the end surface of the sealing member 1.

Figure 5:
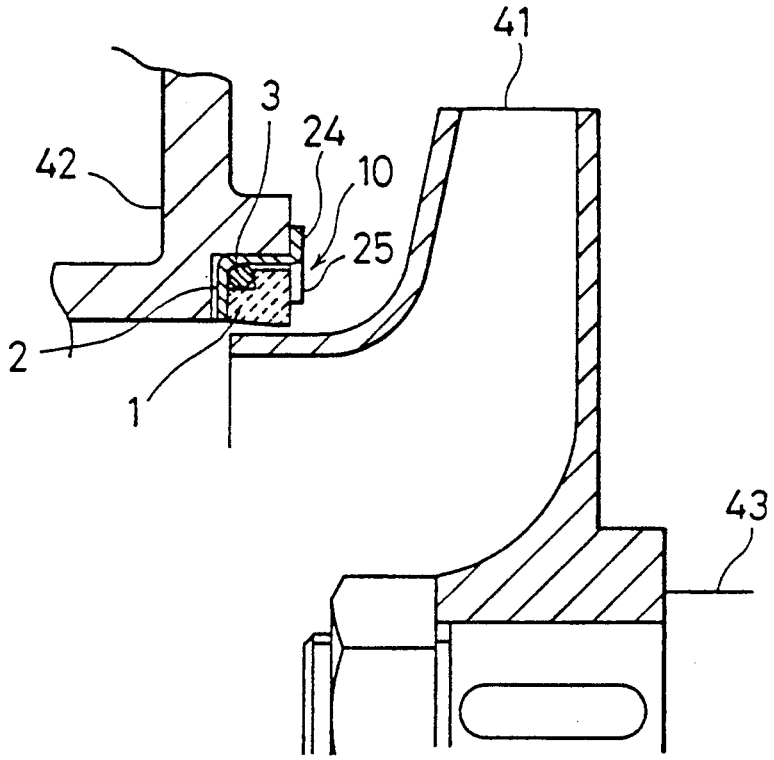
FIG. 5 is a cross-sectional view similar to FIG. 1, but showing an annular sealing member formed of ceramics.

In the embodiment mentioned above, the sealing member 1 is made of a material having a thermal expansion coefficient larger than that of the housing. However, if the sealing member 1 is made of a material such as ceramics (see FIG. 5) having a thermal expansion coefficient smaller than that of the housing, it is not necessary to provide the gap δ between the inner surface of the cylindrical side wall 21 of the housing 2 and the outermost cylindrical surface 21 of the sealing member 1. Alternatively, the size or dimension of the O ring 3 provided between the housing 2 and the sliding member 1 can be selected so as to impart a pre-load, corresponding to the difference in the thermal expansion coefficients of the housing 2 and the sealing member 1, to the O ring 3 in a radial direction. Accordingly, the pre-load applied to the O ring 3 remains at the maximum usage temperature of the pump.

As is apparent from the foregoing description, the liner ring according to the present invention offers the following advantages:

The housing can use the same metal as the pump casing or can use a similar metal having almost the same thermal expansion coefficient as that of the pump casing. Therefore, the housing can be attached to the pump casing by force fit. Further, since the housing is not made of an elastic material such as rubber, handling such as replacement of the housing is easy.

Further, since an elastic member is provided between the housing and the sealing member, even if the sealing member is positioned eccentrically relative to the impeller, the pump can be operated without hindrance.

Furthermore, since there are provided the necessary gap between the housing and the sealing member, and means for preventing the sealing member from rotating relative to the housing, the liner ring is not rotated together with the impeller, and is prevented from falling off, even at high temperatures.

Further, according to the present invention, the housing is made of sheet metal and pressed into shape, and the flange at the opening side of the housing is provided with pawls which can be bent radially inwardly. The housing is provided with notches or projections at the bottom wall thereof. Thus, it is easy to prevent movement of the sealing member in an axial direction and to prevent the sealing member from rotating relative to the housing.

Although certain preferred embodiments of the present invention have been shown and described in detail, it should be understood that various changes and modifications may be made therein without departing from the scope of the appended claims.

What is claimed is:

1. A liner ring for sealing between a pump casing body and an impeller rotatable relative to the pump casing body, said liner ring comprising:

an annular seal housing adapted to be press fit with the pump casing body;

an annular sealing member mounted in said annular seal housing, said annular sealing member being adapted to confront the impeller in a radial direction with a predetermined space between said annular sealing member and the impeller when said annular seal housing is press fit with the pump casing body;

axial fixing means for preventing said annular sealing member from moving relative to said annular seal housing in an axial direction;

an annular elastic member interposed between said annular sealing member and said annular seal housing; and wherein said axial fixing means comprises a pawl portion of said annular seal housing, said pawl portion being bent into a radial orientation abutting a radially extending surface of said annular sealing member.

2. A liner ring as recited in claim 1, wherein said annular sealing member is formed of carbon.

3. A liner ring as recited in claim 1, wherein said annular sealing member is formed of teflon.

4. A liner ring as recited in claim 1, wherein said annular sealing member is formed of ceramic.

5. A liner ring as recited in claim 1, further comprising rotation prevention means for preventing said annular sealing member from rotating relative to said annular seal housing.

6. A liner ring as recited in claim 1, wherein said annular sealing member is formed of a material having a first thermal expansion coefficient; and said annular seal housing is formed of a material having a second thermal expansion coefficient larger than said first thermal expansion coefficient, such that said annular sealing member will expand by a different amount than said annular seal housing upon being heated.

7. A liner ring as recited in claim 1, wherein said annular sealing member is fitted abuttingly in an axial direction with said annular seal housing;

said annular sealing member is formed of a material having a first thermal expansion coefficient; and said annular seal housing is formed of a material having a second thermal expansion coefficient smaller than said first thermal expansion coefficient.

8. A liner ring for sealing between a pump casing body and an impeller rotatable relative to the pump casing body, said liner ring comprising:

an annular seal housing adapted to be press fit with the pump casing body;

an annular sealing member mounted in said annular seal housing, said annular sealing member being adapted to confront the impeller in a radial direction with a predetermined space between said annular sealing member and the impeller when said annular seal housing is press fit with the pump casing body;

axial fixing means for preventing said annular sealing member from moving relative to said annular seal housing in an axial direction;

an annular elastic member interposed between said annular sealing member and said annular seal housing;

rotation prevention means for preventing said annular sealing member from rotating relative to said annular seal housing; and wherein said rotation prevention means comprises at least one notch formed in said annular seal housing and at least one projection projecting from said annular sealing member and engaging in said at least one notch.

9. A liner ring for sealing between a pump casing body and an impeller rotatable relative to the pump casing body, said liner ring comprising:

an annular seal housing adapted to be press fir with the pump casing body;

an annular sealing member mounted in said annular seal housing, said annular sealing member being adapted to confront the impeller in a radial direction with a predetermined space between said annular sealing member and the impeller when said annular seal housing is press fit with the pump casing body;

axial fixing means for preventing said annular sealing member from moving relative to said annular seal housing in an axial direction;

an annular elastic member interposed between said annular sealing member and said annular seal housing;

wherein said annular sealing member is formed of a material having a first thermal expansion coefficient;

wherein said annular seal housing is formed of a material having a second thermal expansion coefficient larger than said first thermal expansion coefficient, such that said annular sealing member will expand by a different amount than said annular seal housing upon being heated;

wherein said annular sealing member is mounted in said annular seal housing such that a predetermined radial gap is formed between said annular sealing member and said annular seal housing; and wherein said predetermined gap corresponds in size to said different amount by which said annular sealing member will expand relative to said annular seal housing upon being heated, in such a manner that said predetermined gap constitutes a means for accommodating thermal expansion of said annular sealing member relative to said annular seal housing.

10. A liner ring for sealing between a pump casing body and an impeller rotatable relative to the pump casing body, said liner ring comprising:

an annular seal housing adapted to be press fit with the pump casing body;

an annular sealing member mounted in said annular seal housing, said annular sealing member being adapted to confront the impeller in a radial direction with a predetermined space between said annular sealing member and the impeller when said annular seal housing is press fit with the pump casing body;

axial fixing means for preventing said annular sealing member from moving relative to said annular seal housing in an axial direction;

an annular elastic member interposed between said annular sealing member and said annular seal housing;

wherein said annular seal housing is formed of sheet metal pressed into a predetermined shape and includes a substantially axially extending cylindrical side wall, a substantially radially extending housing end wall joined to a first end of said cylindrical side wall, a corner portion defined between said cylindrical side wall and said housing end wall, and a radially outwardly extending flange joined to a second end of said cylindrical side wall;

wherein said flange defines a means for limiting axial movement of said annular seal housing relative to the pump casing body when said annular seal housing is press fit with the pump casing body; and wherein said annular elastic member is disposed in said corner portion.

11. A liner ring as recited in claim 10, wherein said housing end wall is provided with a first engaging portion, and said annular sealing member is provided with a second engaging portion engaged with said first engaging portion to prevent said annular sealing member from rotating relative to said annular seal housing.

12. A centrifugal pump comprising:

a pump casing body;

an impeller rotatable mounted in said pump casing body; and a liner ring comprising an annular seal housing press fit with said pump casing body;

an annular sealing member mounted in said annular seal housing and confronting said impeller in a radial direction with a predetermined spaced between said annular sealing member and said impeller, an annular elastic member interposed between said annular sealing member and said annular seal housing;

wherein said liner ring further comprises axial fixing means for preventing said annular sealing member from moving relative to said annular seal housing in an axial direction; and wherein said axial fixing means comprises a pawl portion of said annular seal housing, said pawl portion being bent into a radial orientation abutting a radially extending surface of said annular sealing member.

13. A centrifugal pump as recited in claim 12, wherein said annular sealing member is formed of carbon.

14. A centrifugal pump as recited in claim 12, wherein said annular sealing member is formed of teflon.

15. A centrifugal pump as recited in claim 12, wherein said annular sealing member is formed of ceramic.

16. A centrifugal pump as recited in claim 13, wherein said liner ring further comprises rotation prevention means for preventing said annular sealing member from rotating relative to said annular sealing housing.

17. A centrifugal pump as recited in claim 12, wherein said annular sealing member is formed of a material having a first thermal expansion coefficient; and said annular seal housing is formed of a material having a second thermal expansion coefficient larger than said first thermal expansion coefficient, such that said annular sealing member will expand by a different amount than said annular seal housing upon being heated.

18. A centrifugal pump as recited in claim 12, wherein said annular sealing member is fitted abuttingly in an axial direction with said annular seal housing;

said annular sealing member is formed of a material having a first thermal expansion coefficient; and said annular seal housing is formed of a material having a second thermal expansion coefficient smaller than said first thermal expansion coefficient.

19. A centrifugal pump comprising:

a pump casing body;

an impeller rotatably mounted in said pump casing body; and a liner ring comprising an annular seal housing press fit with said pump casing body, an annular sealing member mounted in said annular seal housing and confronting said impeller in a radial direction with a predetermined space between said annular sealing member and said impeller, an annular elastic member interposed between said annular sealing member and said annular seal housing;

wherein said liner ring further comprises rotation prevention means for preventing said annular sealing member from rotating relative to said annular sealing housing; and wherein said rotation prevention means comprises at least one notch formed in said annular seal housing and at least one projection projecting from said annular sealing member and engaging in said at least one notch.

20. A centrifugal pump comprising:

a pump casing body;

an impeller rotatably mounted in said pump casing body; and a liner ring comprising an annular seal housing press fit with said pump casing body, an annular sealing member mounted in said annular seal housing and confronting said impeller in a radial direction with a predetermined space between said annular sealing member and said impeller, an annular elastic member interposed between said annular sealing member and said annular seal housing;

wherein said annular sealing member is formed of a material having a first thermal expansion coefficient;

wherein said annular seal housing is formed of a material having a second thermal expansion coefficient larger than said first thermal expansion coefficient, such that said annular sealing member will expand by a different amount than said annular seal housing upon being heated;

wherein said annular sealing member is mounted in said annular seal housing such that a predetermined radial gap is formed between said annular sealing member and said annular seal housing; and wherein said predetermined gap corresponds in size to said different amount by which said annular sealing member will expand relative to said annular seal housing upon being heated, in such a manner that said predetermined gap constitutes a means for accommodating thermal expansion of said annular sealing member relative to said annular seal housing.

21. A centrifugal pump comprising:

a pump casing body;

an impeller rotatably mounted in said pump casing body; and a liner ring comprising an annular seal housing press fit with said pump casing body, an annular sealing member mounted in said annular seal housing and confronting said impeller in a radial direction with a predetermined space between said annular sealing member and said impeller, an annular elastic member interposed between said annular sealing member and said annular said housing;

wherein said annular seal housing is formed of sheet metal pressed into a predetermined shape and includes a substantially axially extending cylindrical side wall, a substantially radially extending housing end wall joined to a first end of said cylindrical side wall, a corner portion defined between said cylindrical side wall and said housing end wall, and a radially outwardly extending flange joined to a second end of said cylindrical side wall;

wherein said flange defines a means for limiting axial movement of said annular seal housing relative to said pump casing body when said annular seal housing is press fit with the pump casing body; and wherein said annular elastic member is disposed in said corner portion.

22. A centrifugal pump as recited in claim 21, wherein said housing end wall is provided with a first engaging portion, and said annular sealing member is provided with a second engaging portion engaged with said first engaging portion to prevent said annular sealing member from rotating relative to said annular seal housing.

* * * * *